United States Patent [19]

Watanabe et al.

[11] Patent Number: 4,763,047

[45] Date of Patent: Aug. 9, 1988

[54] ELECTRON GUN

[75] Inventors: Yuzuru Watanabe, Tokyo; Yoshifumi Nakayama, Chiba; Masanori Ando, Kanagawa; Masahiro Kikuchi, Tokyo, all of Japan

[73] Assignee: Sony Corporation, Tokyo, Japan

[21] Appl. No.: 47,578

[22] Filed: May 8, 1987

Related U.S. Application Data

[63] Continuation of Ser. No. 826,836, Feb. 6, 1986, abandoned.

[30] Foreign Application Priority Data

Feb. 15, 1985 [JP] Japan ..... 60-27726

[51] Int. Cl.[4] ..... H01J 29/58

[52] U.S. Cl. ..... 315/382; 315/15; 315/368; 313/449

[58] Field of Search ..... 315/14, 15, 368, 382; 313/414, 449, 412

[56] References Cited

U.S. PATENT DOCUMENTS

| | | | |
|---|---|---|---|
| 4,058,753 | 11/1977 | Blacker et al. | 313/449 |
| 4,143,293 | 3/1979 | Hosokoshi et al. | 313/414 |
| 4,368,405 | 1/1983 | Takenaka et al. | 313/449 |
| 4,443,736 | 4/1984 | Chen | 313/414 |
| 4,583,024 | 4/1986 | Chen | 313/414 |

*Primary Examiner*—Theodore M. Blum

*Attorney, Agent, or Firm*—Hill, Van Santen, Steadman & Simpson

[57] ABSTRACT

An electron gun employed in a color cathode ray tube, or the like, adapted, when electron beams are deflected in a convergence free deflecting magnetic field, to achieve optimal focused conditions for both the electron beam landing at the center and that landing at the corners of a screen by making, within a principal converging region for converging the electron beams, the converging angle in the vertical direction smaller than that in the horizontal direction and by forming, within an object point forming region, the object point in the vertical direction at a further position than where the object point in the horizontal direction is formed.

13 Claims, 12 Drawing Sheets

ELECTRON GUN

This is a continuation of application Ser. No. 826,836, filed Feb. 6, 1986, now abandoned.

BACKGROUND OF THE INVENTION

1. Field of the Invention

The present invention relates to an electron gun to be employed in a cathode ray tube.

2. Description of the Prior Art

In an electron gun of the type employed in a cathode ray tube, an electron beam or electron beams are emitted from a single or plurality of cathodes and the single electron beam or a plurality of electron beams are converged by a single principal lens. In general, such an electron gun is divided into two regions of an object point forming region (a cathod lens region) and a principal converging region (a principal lens region). The characteristics of the electron beam on the fluorescent screen are determined by these two lens regions. Since a circular beam spot is to be produced by ordinary electron guns, the above mentioned object point forming region and principal converging region are frequently formed of electrodes arranged in a rotatory symmetric configuration.

The deflecting magnetic field to be provided by the electromagnetic deflecting means in the cathode ray tube is a so-called convergence free deflecting magnetic filed (hereinafter to be called a CFD magnetic field) of which the horizontal deflecting magnetic filed (1) forms a pin magnetic field and the vertical magnetic filed (2) forms a barrel magnetic field as shown in FIG. 19. Hence, in an electron gun with the electrodes arranged in a rotatory symmetric configurations as above, the focal distance (hereinafter the f value) of the electron beam is the same in both the vertical direction and the horizontal direction, i.e., the vertical f value ($f_V$) and the horizontal f value ($f_H$) are equal ($f_V=f_H$). The electron beam (4) when influenced by the CFD magnetic field is, particularly at the corners of the screen (3), overfocused in the vertical direction (refer to FIG. 21) and underfocused in the horizontal direction (refer to FIG. 20). This is due to the lensing action or characteristics of the CFD magnetic field, that is, when an electron beam is deflected to the corner portion, a convex lensing action is developed in the vertical direction and concave lensing action is developed in the horizontal direction. Therefore, when seen on the screen (3), as shown in FIG. 22, a circular beam spot (4*a*) is obtained at the center of the screen and optimal focusing is effected there, but an elongated beam spot (4*b*) is formed at the corners and is accompanied by a halo (5).

Under these circumstances, it has been known that the quality of the picture image on a color cathode ray tube, particulary the beam spots, becomes deteriorated at the peripheral portion of the screen and, in particular, at the four corners. On the other hand, there are trends for flattening the screen and consumerization of intermediateresolution cathode ray tubes, which have resulted in increasing demands for improvements of the beam spot quality at the corners. For example, in a character display, improvement of beam spots at the screen corners is strongly desired.

There has been developed a system to obtain an optimally focused beam spot with less halo at the corners by providing a weaker convex lens in the vertical direction and a stronger convex lens in the horizontal direction.

In other words, the horizontal focal distance ($f_H$) is less than vertical focal distance ($f_V$) (i.e., $f_H<f_V$). In this case, however, a circular beam spot cannot be obtained at the center of the screen (3) because, when the horizontal focusing was adjusted to be optimal, the vertical focusing became underfocused, and the obtained beam spot (4*a*) at the center became a vertically elongated one as shown in FIG. 23.

These and other objects of this invention will become apparent from the following disclosure and appended claims.

SUMMARY OF THE INVENTION

Accordingly, a primary object of the present invention is to provide an electron gun which attains optimal focusing conditions at both the center and the corners of the screen.

The invention contemplates an electron gun wherein in the principal converging region thereof the vertical converging angle $\theta_V$ of the electron beam is made smaller than the horizontal converging angle $\theta_H$, and in the object point forming region thereof, the object point in the vertical direction may be formed at a position further, i.e., closer to the cathode, than the object point in the horizontal direction.

As means for making the vertical converging angle $\theta_V$ smaller, the electrodes forming the principal converging region have been arranged such that the distance therebetween at their vertical (top and bottom) segments is shorter than that at their horizontal (sideways) segments. Alternatively, the shapes of the openings in the opposing end faces of the electrodes forming the principal converging region have been arranged such that the vertical dimensions thereof is different from the horizontal dimension.

On the other hand, as means for forming the object point in the vertical direction at a further position than that in the horizontal direction in the object point forming region, the through hole for electron beam bored in the control electrode (i.e., the first grid $G_1$), has been made oblong.

The invention is applicable to electron guns of both bipotential type and unipotential type.

According to the invention, since the vertical converging angle in the vertical direction $\theta_V$ is adapted to be smaller, when an electron beam is deflected by the CFD magnetic field, an optimally focused beam spot with little halo is obtained at the corner of the screen. Since, at the same time, the object point in the vertical direction is formed at a further position than the object point in the horizontal direction in the object point forming region, optimal focusing conditions in both horizontal and vertical directions are achieved in the center of the screen and a circular beam spot is obtained there. Therefore, focusing conditions of the electron beams become uniform all over the screen and, further, a focus voltage can be determined which is optimal for the center and corners of the screen to the degree practically free from any problem in a current region (in a region of the current to be pulled from the cathode, hence in an operating region).

DESCRIPTION OF THE PREFERRED EMBODIMENT

The preferred embodiment of the present invention will be described with reference to the accompanying drawings in the following.

For ease in understanding, the description will first discuss the arrangement (which is employed in the invention) to make the converging angle in the vertical direction $\theta_V$ smaller than the converging angle in the horizontal direction $\theta_H$ in the principal converging region (principal lens region) and to thereby provide a beam spot with little halo at the corner of the screen.

Figure 10:
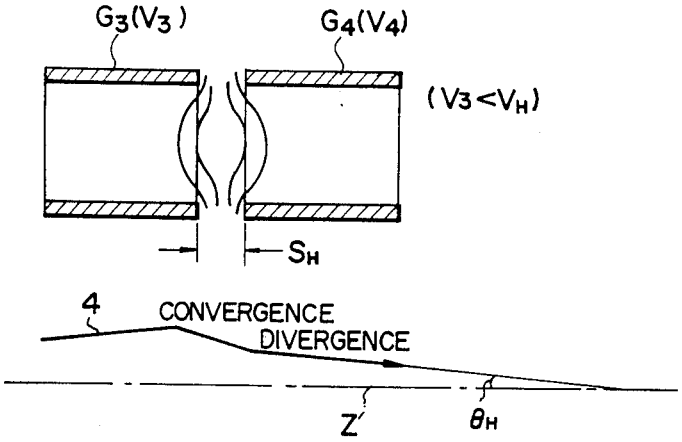
FIGS. 10 and 11 are a horizontal cross-sectional view and a vertical cross-sectional view of third grid $G_3$ and fourth grid $G_4$ constituting a bipotential lens employed in the invention.
Figure 11:
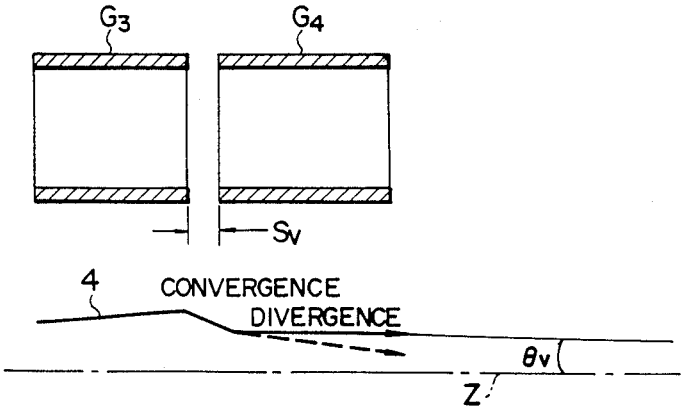
Figure 12:
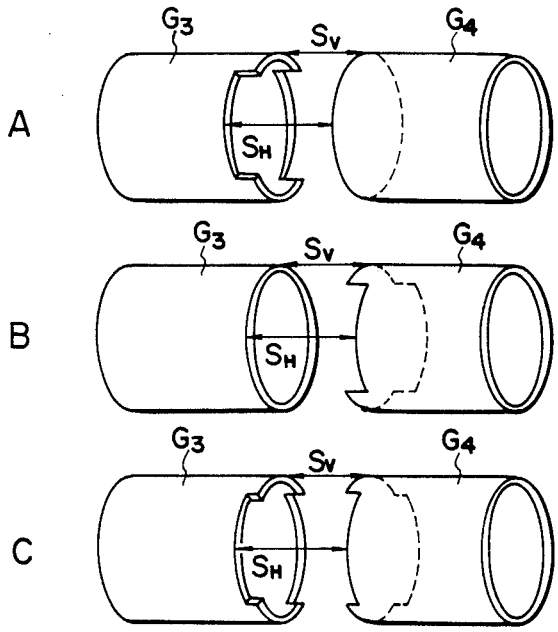
FIGS. 12A to 12C are perspective views showing examples of arrangement of the third grid $G_3$ and fourth grid $G_4$.

FIGS. 10 to 13 show the cases where the above arrangement is applied to a bipotential type electron gun. These drawings only indicate the portion of the gun including the third grid $G_3$ and the fourth grid $G_4$ which constitute the principal lens (bipotential lens). The fourth grid $G_4$ is applied with anode voltage $V_H$ and the third grid $G_3$ is applied with focus voltage $V_3$ ($V_3<V_H$). As an example, as shown in FIG. 10 (cross section in the horizontal direction) and FIG. 11 (cross section in the vertical direction), the third grid $G_3$ and the fourth grid $G_4$ are arranged such that the distance between them at their vertical segments $S_V$ is smaller than that at their horizontal segments $S_H$ ($S_V<S_H$). By this arrangement, the electron beam (4) emitted from the cathode is converged in the principal lens region by the converging angle (the angle of the electron beam with reference to the center axis Z of the electron gun) $\theta_H$ (refer to FIG. 10) with reference to the horizontal direction and converged by the converging angle $\theta_V$ with reference to the vertical direction (refer to FIG. 11), which is smaller than the converging angle $\theta_H$, and therefore, the f value in the vertical direction ($f_V$) becomes longer than the f value in the horizontal direction ($f_H$). FIGS. 12A to 12C show examples of the arrangement of the third grid $G_3$ and fourth grid $G_4$ for achieving the condition $S_V<S_H$ between them. FIG. 12A shows the case where the end face side of the third grid $G_3$ facing the fourth grid $G_4$ is adapted such that the end face portion thereof in the vertical direction is projecting forwardly of the portion in the horizontal direction, whereby the condition $S_V<S_H$ is achieved. FIG. 12B shows the case where the end face side of the fourth grid $G_4$ facing the third grid $G_3$ is adapted such that the end face portion thereof in the vertical direction is projecting forwardly of the portion in the horizontal direction, whereby the condition $S_V<S_H$ is achieved. FIG. 12C shows the case where the end face sides of both the third grid $G_3$ and fourth grid $G_4$ facing each other are adapted such that their end face portions in the vertical directions are projecting forwardly than the portions in the horizontal direction, whereby the condition $S_V<S_H$ is achieved.

Figure 13:
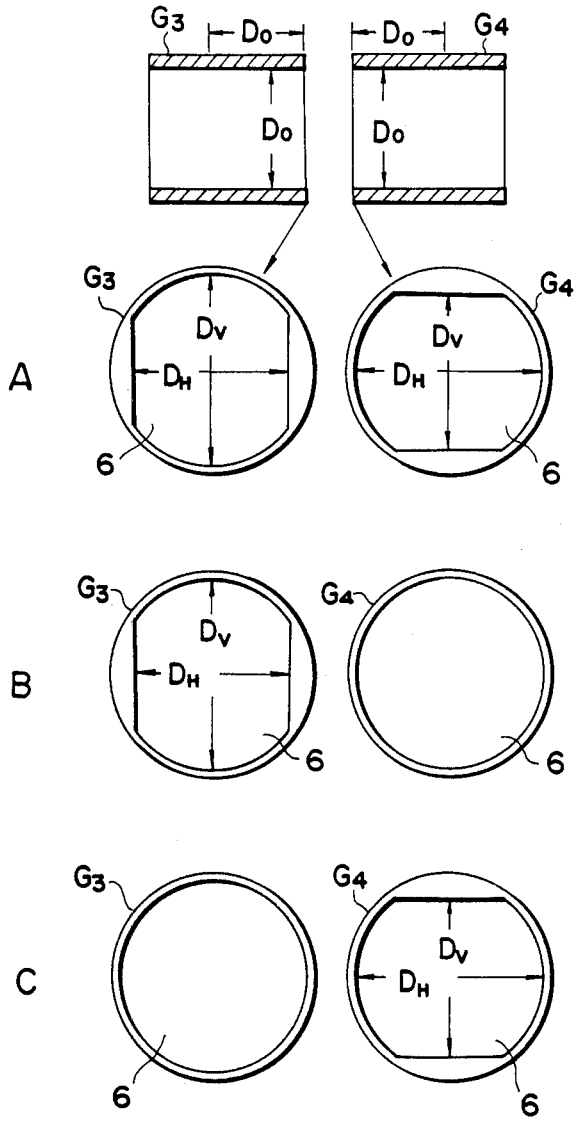
FIGS. 13A to 13C are drawings showing shapes of openings in the end faces of the third grid $G_3$ and fourth grid $G_4$.

Another example of the application to the bipotential type, is shown in FIG. 13, where the distance $S_V$is kept equal to $S_H$($S_V=S_H$), but the shapes of the openings (6) facing each of the cylindrical third grid $G_3$ and fourth grid $G_4$ constituting the principal lens are changed. That is, as shown in FIG. 13A, the shape of the end face opening of the thrid grid $G_3$ opposite to the fourth grid $G_4$ may be changed so that the dimension of the opening in the horizontal direction $D_H$ will become smaller than the dimension of the opening in the vertical direction $D_V$ (i.e., $D_V>D_H$, where the dimension of the opening in the vertical direction $D_V$ is taken as a reference dimension), and the shape of the end face opening of the fourth grid $G_4$ opposite to third grid $G_3$ may be changed so that the dimension of the opening in the vertical direction $D_V$ will become smaller than the dimension of the opening in the horizontal direction $D_H$ (i.e., $D_V<D_H$) where the dimension of the opening in the horizontal direction $D_H$ is taken as a reference dimension). Or, as shown in FIG. 13B, only the shape of the end face opening of the third grid $G_3$ may be changed as above ($D_V>D_H$), while the opening of the fourth grid $G_4$ is kept in a circular shape. Or, as shown in FIG. 13C, the shape of the end face opening of the fourth grid $G_4$only may be changed as above ($D_V<D_H$) keeping the opening of the third grid $G_3$ in a circular shape. In any case of Figs. 13A, 13B and 13C, the vertical converging angle $\theta_V$ becomes smaller than the horizontal converging angle $\theta_H$ and the vertical f value ($f_V$) becomes longer than the horizontal f value ($f_H$). In the case of FIG. 13, the shape of the opening was specified to be provided at the end face portion of the grid, but the same effects can be obtained even if the specific shape is provided in the region inside the cylindrical grid, when the inner diameter of the grid given by $D_0$, within the distance $D_0$ along the length from the end face of the grid. By arranging the third grid $G_3$ and the fourth grid $G_4$ constituting the bipotential lens as described above, optimally focused beam spots with little halo can be obtained from the electron beams deflected by the CFD magnetic field at the corners of the screen.

Figure 14:
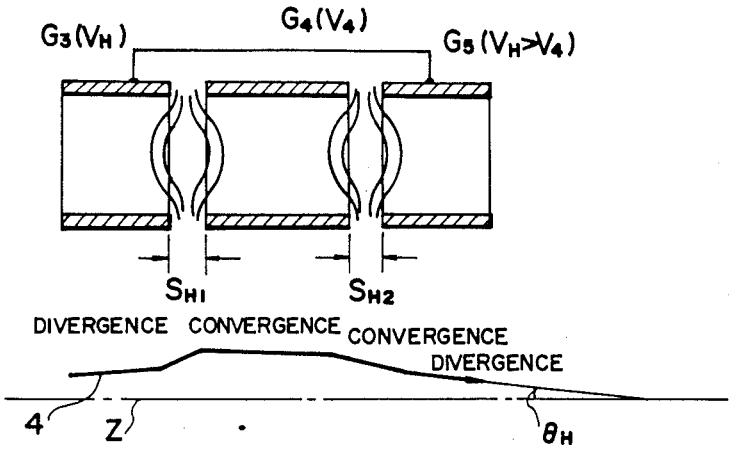
FIGS. 14 and 15 are a horizontal cross-sectional view and a vertical cross-sectional view of the third grid $G_3$to fifth grid $G_5$ constituting a unipotential lens employed in the invention.
Figure 15:
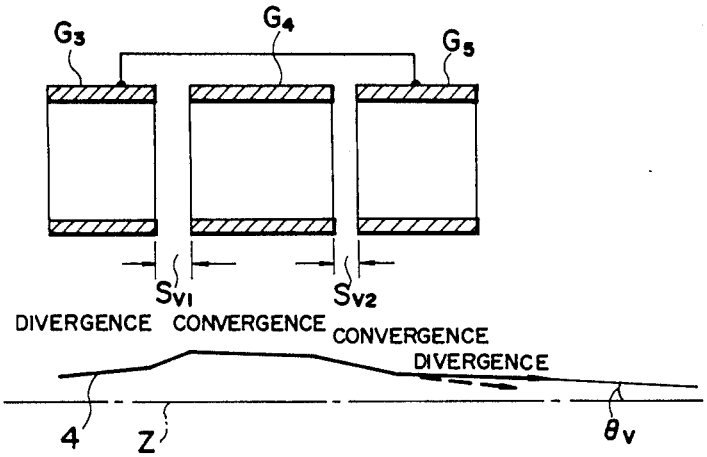
Figure 16:
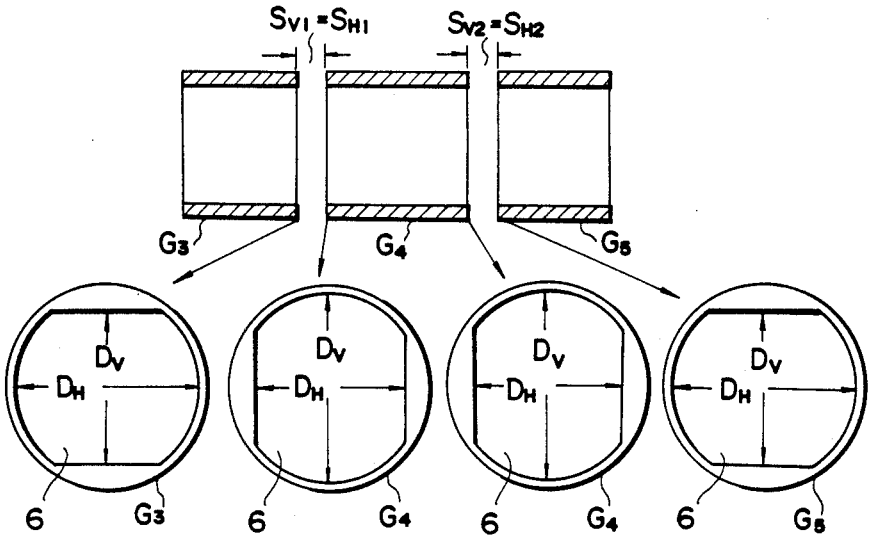
FIG. 16 is a drawing showing shapes of openings in the end faces of the third grid $G_3$ to fifth grid $G_5$.

FIGS. 14 to 16 show the cases where the above arrangement was applied to a unipotential type electron gun, in which each drawing shows only the portion including the third grid $G_3$, the fourth grid $G_4$, and the fifth grid $G_5$ constituting the principal lens (unipotential lens). The anode voltage $V_H$ is applied to the third grid $G_3$ and the fifth grid $G_5$, the focus voltage $V_4$ is applied to the fourth grid $G_4$, and the focus voltage is less than the anode voltage ($V_4<V_H$). As an example, as shown in FIG. 14 (horizontal cross section) and FIG. 15 (vertical cross section), the distance between the third grid $G_3$ and the fourth grid $G_4$ in the vertical cross section $S_{V1}$ and that in the horizontal cross section $S_{H1}$ as well as the distance between the fourth grid $G_4$ and the fifth grid $G_5$ in the vertical cross section $S_{V2}$ and that in the horizontal cross section $S_{H2}$ may be selected so as to satisfy any of the following three conditions (i), (ii) and (iii). In condition (1) $S_{V1}<S_{H1}$ and $S_{V2}=S_{H2}$. In condition (ii) $S_{V2}<S_{H2}$ and $S_{V1}=S_{H1}$. In condition (iii) $S_{V2}<S_{H2}$ and $S_{V1}<S_{H1}$. In any selection of these three conditions (i), (ii), and (iii), the spot of the electron beam emitted from the cathode is converged in the principal lens region horizontally at the converging angle $\theta_H$ as shown in FIG. 14 and vertically at the converging angle $\theta_V$, which is smaller than the angle $\theta_H$, as shown in FIG. 15, and as a result $f_V$ becomes larger than $f_H$ ($f_V>f_H$). To achieve a specific structure for these grids, the arrangement as earlier shown in FIG. 12 can be employed. As another example of the application to the unipotential type, the shapes of the openings (6) with which the grids $G_3$, $G_4$, and $G_5$ oppose each other may be changed as shown in FIG. 16 with the distances therebetween remaining in the states of $S_{V1}=S_{H1}$ and $S_{V2}=S_{H2}$. That is, the shape of the opening in the end face of the third grid $G_3$ opposite to the fourth grid $G_4$ may be changed so that the dimensional relationship $D_V<D_H$ is provided. Or, the opening in the end face of the fourth grid $G_4$ opposing the third grid $G_3$ may be changed so that the dimensional relationship $D_V>D_H$ is provided. Or, the shape of the opening in the end face of the fourth grid $G_4$ opposing the fifth grid $G_4$ may be changed so that the dimensional relationship $D_V>D_H$ is provided. Or, the shape of the opening in the end face of the fifth grid $G_5$ opposing the fourth grid $G_4$ may be changed so that the dimensional relationship $D_V<D_H$ is provided. Further, it is also possible to arrange one opening in the end face, at the minimum, of the grids $G_3$, $G_4$, and $G_5$ to be formed into the shape as shown in FIG. 16 and all the other openings to be left in the circular shape, or a few of these shapes may be selected and combined for use. In any case, such change in the shapes of the openings in the end faces provides the condition $\theta_V<\theta_H$ for the converging angles and makes the vertical f value ($f_V$) longer than the horizontal f value ($f_H$). In this case also, the same effects can be obtained, as described before, even if the shape as described above is provided in the region inside the cylindrical grid, when the inner diameter of the grid given by $D_0$, within the distance $D_0$ along the length from the end face of the grid. By the above described arrangement of the third grid $G_3$ to fifth grid $G_5$ constituting the unipotential lens, when the electron beam is deflected in the CFD magnetic field, optically focused beam spots with little halo are obtained at the corners of the screen.

Figure 17:
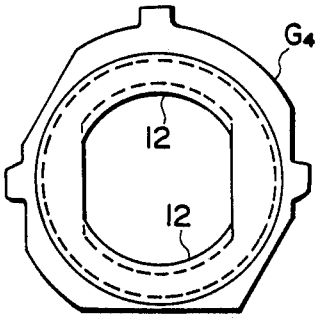
FIGS. 17 and 18 are a plan view and a crosssectional view showing an example of a shape of an opening in the end surface of a grid.
Figure 18:
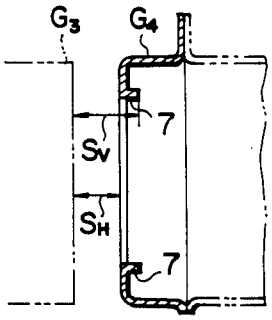
Figure 19:
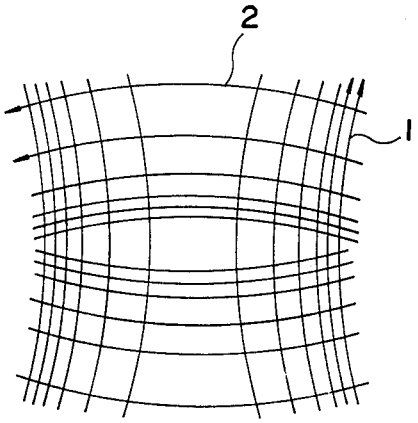
FIG. 19 is a schematic diagram of a convergence free deflecting magnetic field used in the description of the invention.
Figure 20:
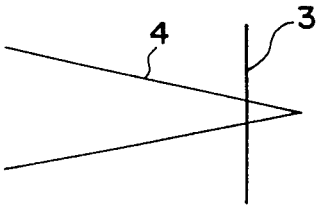
FIGS. 20 and 21 are diagrams showing focused states of an electron beam at a corner portion in the horizontal direction and in the vertical direction, respectively.
Figure 21:
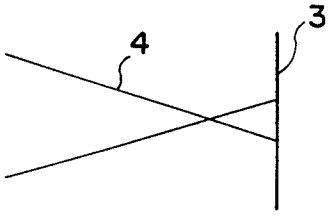
Figure 22:
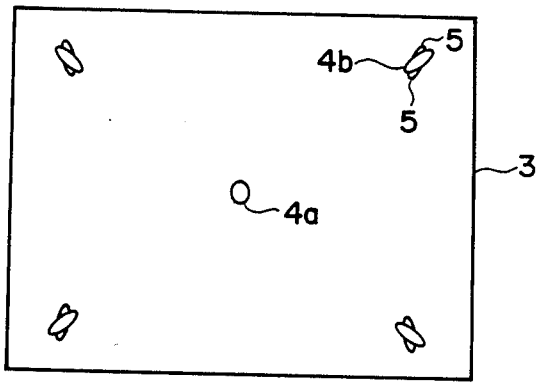
FIGS. 22 and 23 both are plan views showing beam spots on the screen used for description of the invention.
Figure 23:
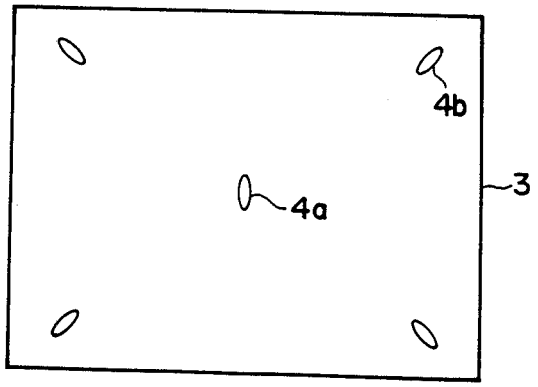

FIGS. 17 and 18 show, in a plan view and a cross-sectional view, an example of the shape of the opening in the end face of a grid. In this case, the example of the shape of the opening in the end face of a fourth grid $G_4$ of a unipotential type electron gun opposing a third grid $G_3$ is indicated and the same was formed by press work. The present example is such that, since the horizontal dimension $S_H$ of the opening had been made too small, and as a result, the effect to reduce the vertical converging angle $\theta_V$ became too strong, the folded back portion (7) was provided to make the distance between the fourth grid $G_4$ and the third grid $G_3$ in the vertical cross section, $S_V$, larger, in substance, than the distance in the horizontal cross section, $S_H$, thereby to weaken the above effect and adjust the converging angle $\theta_V$ to a proper magnitude.

The present invention is structured as described so far such that the vertical converging angle $\theta_V$ is made smaller than the horizontal converging angle $\theta_H$ chiefly in the principal lens region, and, in addition, structured such that an object point in the vertical direction is formed at a further position than an object point in the horizontal direction in the cathode lens region.

Figure 1:
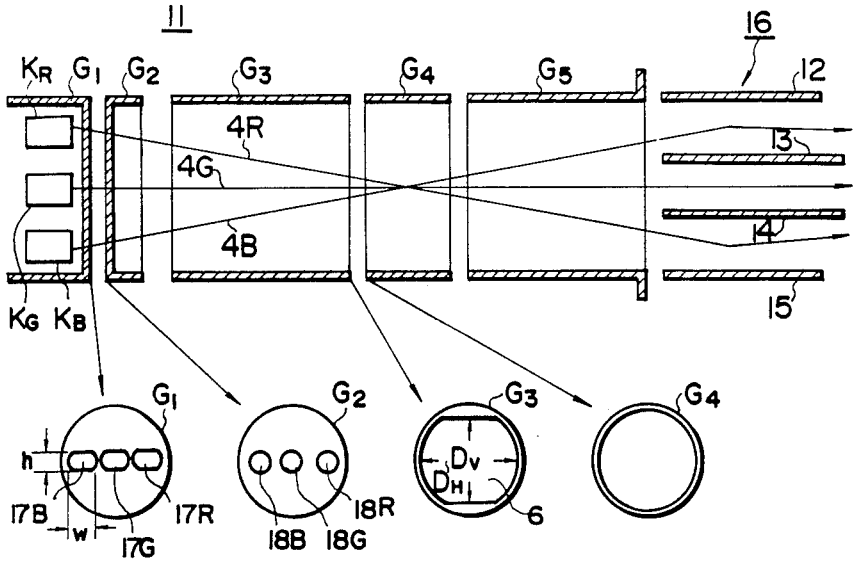
FIG. 1 is a diagram showing the structure of an example of an electron gun according to the invention.
Figure 5:
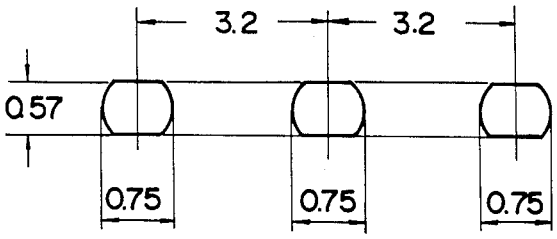
FIG. 5 is a plan view showing an example of the shape of through holes for electron beams bored in a first grid $G_1$ employed in the invention.
Figure 6:
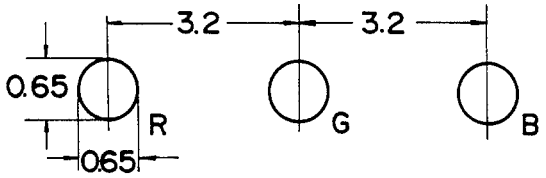
FIG. 6 is a plan view showing an example for comparison of shape of through holes for electron beams bored in an ordinary first grid $G_1$.

FIG. 1 indicates an embodiment of the invention applied to a multi-beam single electron gun for a color cathode ray tube. The electron gun (11) is of a unipotential type and consists of the first grid $G_1$, second grid $G_2$, third grid $G_3$, fourth grid $G_4$, and fifth grid $G_5$ arranged along the same axis commonly for an in-line type cathodes $K_R$, $K_G$, and $K_B$ and an electrostatic convergence means (16) comprising four electrode plates (12), (13), (14), and (15) disposed in the forward direction of the fifth grid $G_5$. The electron beams (4R), (4G), and (4B) from the three cathodes $K_R$, $K_G$, and $K_B$ intersect in the center of the principal lens constituted of the third grid $G_3$, fourth grid $G_4$, and fifth grid $G_5$ and diverge therefrom to enter the converging means (16) and are converged on the fluorescent screen. In the present example, while the distance between the third grid $G_3$ and the fourth grid $G_4$ in the vertical cross section $S_{V1}$ and that in the horizontal cross section $S_{H1}$ are kept equal, $S_{H1}=S_{H1}$, and the distance between the fourth grid $G_4$ and the fifth grid $G_5$ in the vertical cross section $S_{V2}$ and that in the horizontal cross section $S_{H2}$ are kept equal, $S_{V2}=S_{H2}$, only the shape of the opening in the end face of the third grid $G_3$ opposing the fourth grid $G_4$ is made such that, as shown in FIG. 1, its $D_V$ is smaller than the $D_H$ ($D_V<D_H$), and so, is formed, for example, substantially into an oval shape. The opening in the end face of the fourth grid $G_4$ opposing the thrid grid $G_3$ is made circular. The openings in the end faces of the fourth grid $G_4$ and fifth grid $G_5$ opposing each other are also made circular. And, further, the through holes (17R), (17G), and (17B) are for the beams in the first grid $G_1$ are formed into an oblong shape, whereas the through holes (18R), (18G), and (18B) in the second grid $G_2$ for the beams are provided in a circular shape. In FIG. 5, an example of the beam through holes (17R), (17G), and (17B) in the first grid $G_1$ is shown in comparison with the circular beam through holes (17R), (17G), and (17B) in the ordinary first grid $G_1$ (refer to FIG. 6). The beam through holes (17R), (17G), and (17B) in the first grid $G_1$ in the embodiments of FIG. 5 is preferred to be formed into an oblong shape within the range of $0.7\leqq h/w<1$, and the opening in the third grid $G_3$ is preferred to be formed into an oblong shape within the range of $0.7\leqq D_V/D_H<1$.

In the electron gun (11) as structured as above, since the shape of the opening in the end face of the third grid $G_3$ is made into an oval shape ($D_V < D_H$), the vertical converging angle $\theta_V$ is made smaller than the horizontal converging angle $\theta_H$, and therefore, the vertical f value ($f_V$) becomes longer than the horizontal f value ($f_H$) ($f_V > f_H$). Hence, when the electron beams are deflected in the CFD magnetic field, optimally focused beam spots with little halo are obtained at the corners of the screen.

At the same time, since the through holes (17R), (17G), and (17B) for the beams in the first grid $G_1$ are formed into an oblong shape, the object point in the vertical direction with a relatively longer f value is shifted at a further position, i.e., closer to the cathode, than the object point in the horizontal direction with a shorter f value.

Figures 3, 4:
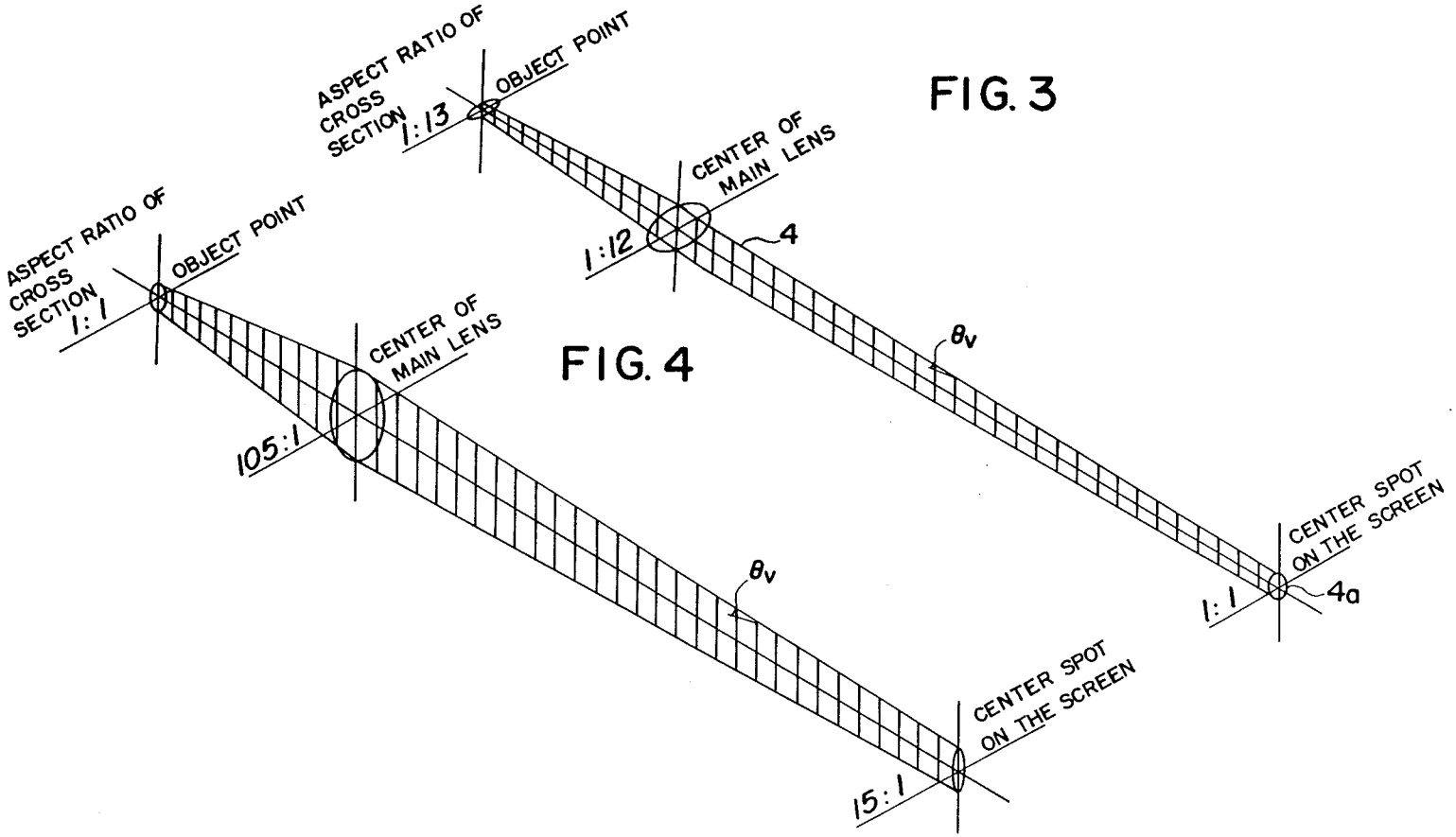
FIG. 3 is a diagram indicating a state of a beam spot obtained from the electron gun of FIG. 1.
FIG. 4 is a diagram indicating a state of a beam spot obtained from the electron gun of FIG. 2.

By such arrangement, as shown in FIG. 3, the electron beam (4) is provided with optimum focused conditions at the center of the screen in both the horizontal direction and the vertical direction and produces a circular beam spot (4*a*).

Figure 2:
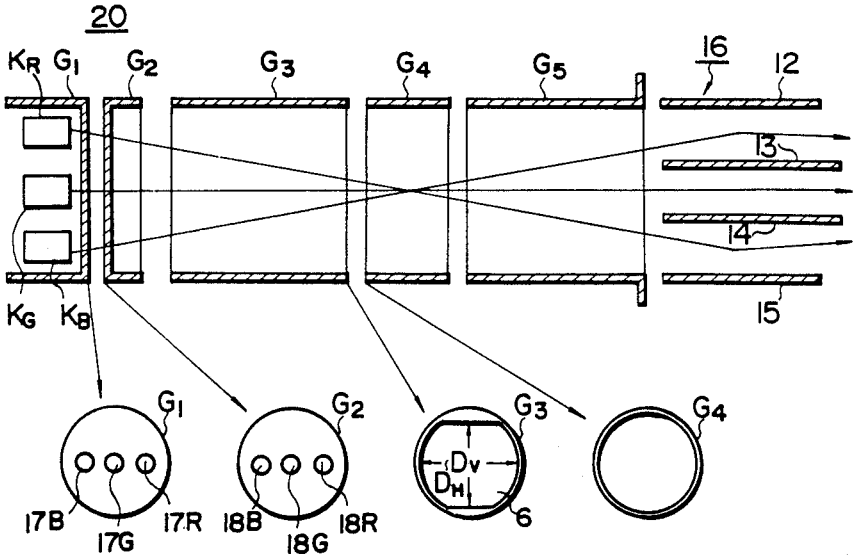
FIG. 2 is a diagram showing the structure of an example of an electron gun to be used for comparison in the description of the invention.

In FIG. 4 is shown, for reference, a shape of beam spot produced at the center of the screen by an electron gun (20) as shown in FIG. 2, which is of the same structure as the electron gun in FIG. 1, except for circular beam through holes (17R), (17G), and (17B) provided in the first grid $G_1$. With this electron gun (20), although aberration of the spot at the corner of the screen is kept small since the vertical converging angle $\theta_V$ of the electron beam is smaller, the spot at the center of the screen becomes a vertically elongated spot (4*a*).

In the case of the electron gun according to the invention as shown in FIG. 1, since the cross-sectional area of the beam in the center of the principal lens is smaller as shown in FIG. 3, aberration of the beam spot at the corner becomes less than that in the case of FIG. 2 and FIG. 4.

Figure 8:
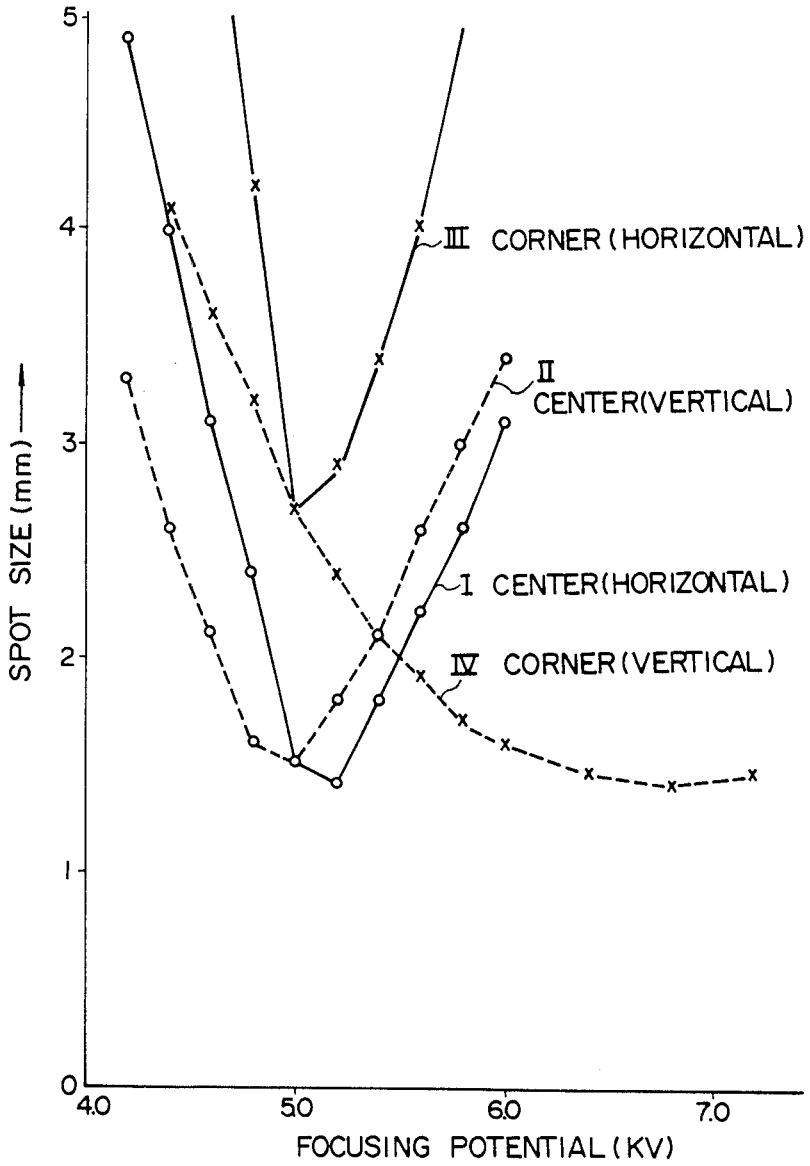
FIG. 8 shows characteristics of the beam spots against focus voltage.

FIG. 8 shows the characteristics of the beam spot size produced by the electron gun according to the invention at the center and corner of the screen against the focus voltage values, wherein the beam used is the central beam and the cathode current has been kept constantly at 1 mA. The curves (I) and (II) in FIG. 8 are horizontal and vertical size, respectively, of the beams landing on the center portion of the screen and the curves (III) and (IV) are horizontal and vertical size, respectively, of the beams landing on the corner portion of the screen.

Figure 7:
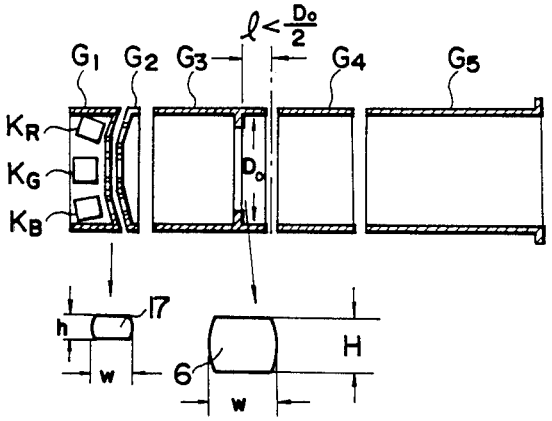
FIG. 7 is a diagram showing the structure of another example of the electron gun according to the invention.

In the electron gun of FIG. 7, the ratio of the vertical dimension (h) to the horizontal dimension (w) of the beam through hole (17) in the first grid $G_1$ was w:h=1.3:1 and the radio of the vertical dimension (H) to the horizontal dimension (W) of the opening in the third grid $G_3$ was W:H=10:9. As apparent from the characteristics in FIG. 8, a focus voltage which is optimal for spot size both at the center and corners of the screen can be determined.

Figure 9:
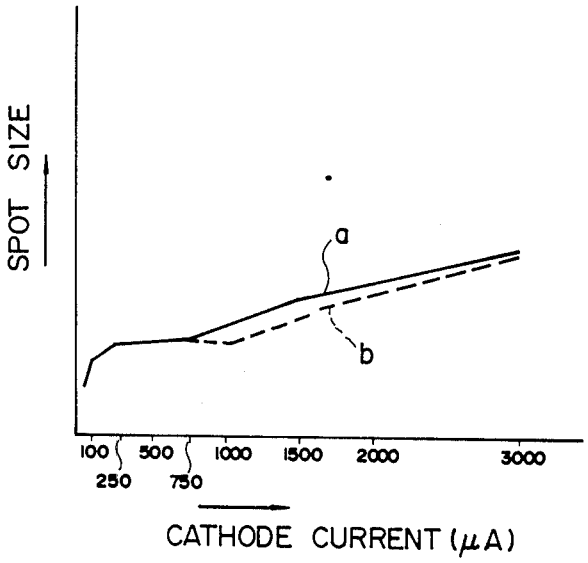
FIG. 9 shows characteristics of variations of the spot size at the center of the screen against cathode current.

FIG. 9 shows the characteristics of the beam spot size at the center of the screen against the cathode current, in which the solid line (a) indicates the horizontal size and the dotted line (b) indicates the vertical size. From FIG. 9, it is seen that a circular spot is provided in the center of the screen.

The example described above was of application to a unipotential type multi-beam single electron gun, but the same is applicable to an electron gun of a single-cathode bipotential type of unipotential type.

According to the invention as described as far, the vertical converging angle $\theta_V$ of the electron beam is made smaller than its horizontal converging angle $\theta_H$ in the principal converging region and, further, the object point in the vertical direction is arranged to be formed at a further position than the object point in the horizontal direction in the object point forming region, and so, when an electron beam is deflected in the CFD magentic field, optimally focused beam spots with little halo are obtained at the corner portion of the screen and optimally focused circular spot in both vertical and horizontal directions is obtained at the central portion of the screen. That is, optimal focusing for all over the screen is attained without the need for the correction made in the circuit. And it is also made possible to determine an optimal focus voltage for the spots both at the central portion and the corner portions of the screen. Therefore, the invention is satisfactorily applicable to the electron gun for a cathode ray tube with a flat screen, the intermediate-resolution cathode ray tube, and so forth.

Althrough the invention has been described with respect to preferred embodiment, it is not to be so limited as changes and modifications can be made which are within the full intended scope of the invention as defined by the appended claims.

We claim as our invention:

1. An electron gun for a cathode ray tube comprising, an object point forming lens region and a principal converging lens region, at least one through hole for said electron beam in a first grid electrode within said object point forming lens region is formed with an oblong shape such that the object point in the vertical direction is formed at a further position from said principal converging lens region than the object point in the horizontal direction, and the shapes of openings of electrodes within said principal converging lens region are determined such that the converging angle of said electron beam in the vertical direction is smaller than the converging angle in the horizontal direction so as to provide a beam spot with substantially no halo at the corners as well as the center of a screen in said cathode ray tube; and which includes a thrid grid and a fourth grid forming said principal lens, there being applied an anode voltage ($V_H$) to said fourth grid and a focus voltage ($V_3$) to said third grid wherein the focus voltage ($V_3$) is less than the anode voltage ($V_H$), each of said grids having a vertical segment and a horizontal segment, and the distance between the vertical segments of each grid being less than the distance between the horizontal segments, and wherein the end face of at least one of said grids includes a projecting vertical segment extending toward the end face of the other adjacent grid.

2. An electron gun as in claim 1, wherein the vertical segments of said thrid and fourth grids include projections extending toward each other.

3. An electron gun for a cathode ray tube comprising, an object point forming lens region and a principal converging lens region, at least one through hole for said electron beam in a first grid electrode within said object pont forming lens region is formed with an oblong shape such that the object point in the vertical direction is formed at a further position from said principal converging lens region than the object point in the horizontal direction, and the shapes of openings of electrodes within said principal converging lens region and determined such that the converging angle of said electron beam in the vertical direction is smaller than the converging angle in the horizontal direction so as to provide a beam spot with substantially no halo at the corners as well as the center of a screen in said cathode ray tube, and wherein said gun is of a bipotential type and includes a third gird and a fourth grid forming the principal lens with an anode voltage ($V_H$) applied to the fourth grid and the focus voltage ($V_4$) applied to the third grid with the focus voltage being less than the anode voltage ($V_3 < V_H$), and each of said grids having a vertical segment and a horizontal segment and the distance between the vertical segments being equal to the distance between the horizontal segments, each of said grids having a generally hollow circularly-shaped center and each grid having a vertical distance ($D_V$) and a horizontal distance ($D_H$) and wherein the vertical distance ($D_V$) is greater than the horizontal distance ($D_H$) for the face of the thrid grid facing the fourth grid.

4. An electron gun for a cathode ray tube comprising, an object point forming lens region and a principal converging lens region, at least one through hole for said electron beam in a first grid electrode within said object point forming lens region is formed with an oblong shape such that the object point in the vertical direction is formed at a further position from said principal converging lens region than the object point in the horizontal direction, and the shapes of openings of electrodes within said principal converging lens region and determined such that the converging angle of said electron beam in the vertical direction is smaller than the converging angle in the hozintal direction so as to provide a beam spot with substantially no halo at the corners as well as the center of a screen in said cathode ray tube, and wherein said gun is of a bipotential type and includes a third grid and a fourth grid forming the principal lens with an anode voltage ($V_H$) applied to the fourth grid and the focus voltage ($V_4$) applied to the third grid with the focus voltage being less than the anode voltage ($V_3 < V_H$), and each of said grids having a vertical segment and a horizontal segment and the distance between vertical segments equalling the distance between the horizontal segments, each of said grids having a generally hollow and circularly-shaped center and having a vertical distance ($D_V$) and a horizontal distance ($D_H$) and wherein the horizontal distance ($D_V$) is greater than the vertical dimension ($D_V$) for the face of the fourth grid facing the third grid.

5. An electron gun for a cathode ray tube comprising, an object point forming lens region and a principal converging lens region, at least one through hole for said electron beam in a first grid electrode within said object point forming lens region is formed with an oblong shape such that the object point in the vertical direction is formed at a further position from said principal converging lens region than the object point in the horizontal direction, and the shapes of openings of electrodes within said principal converging lens region are determined such that the converging angle of said electron beam in the vertical direction is smaller than the converging angle in the horizontal direction so as to provide a beam spot with substantially no halo at the corners as well as the center of a screen in said cathode ray tube, and wherein said gun is of the unipotential type having a third grid, a fourth grid and a fifth grid spaced from each other and forming the principal lens, there being an anode voltage ($V_H$) applied to the third and fifth grids and a focus voltage ($V_4$) applied to the fourth grid with the focus voltage being greater than the anode voltage ($V_4 > V_H$), with each of said grids having a vertical segment and a horizontal segments, wherein the distances between the vertical and horizontal segments of the thrid and fourth grids are equal and the distances between the vertical and horizontal segments of the fourth and fifth grids are equal.

6. An electron gun for a cathode ray tube comprising, an object point forming lens region and a principal converging lens region, at least one through hole for said electron beam in a first grid electrode within said object point forming lens region is formed with an oblong shape such that the object point in the vertical direction is formed at a further position from said principal converging lens region than the object point in the horizontal direction, and the shapes of openings of electrodes within said principal converging lens region are determined such that the converging angle of said electron beam in the vertical direction is smaller than the converging angle in the horizontal direction so as to provide a beam spot with substantially no halo at the corners as well as the center of a screen in said cathode ray tube, and wherein said gun is of the unipotential type and having a third grid, a fourth grid and a fifth grid spaced from each other and forming the principal lens, there being an anode voltage ($V_H$) applied to the third and fifth grids and a focus voltage ($V_4$) applied to the fourth grid with the focus voltage being greater than the anode voltage ($V_4 > V_H$), with each of said grids having a vertical segment and the horizontal segment, wherein the distances between the horizontal and vertical segments of the third and fourth grids are equal and the distances between the vertical segments is less than the distances between the horizontal segments for the fourth and fifth grids.

7. An electron gun for a cathode ray tube comprising, an object point forming lens region and a principal converging lens region, at least one through hole for said electron beam in a first grid electrode within said object point forming lens region is formed with an oblong shape such that the object point in the vertical direction is formed at a further position from said principal converging lens region than the object point in the horizontal direction, and the shapes of openings of electrodes within said principal converging lens region are determined such that the converging angle of said electron beam in the vertical direction is smaller than the converging angle in the horizontal direction so as to provide a beam spot with substantially no halo at the corners as well as the center of a screen in said cathode ray tube, and wherein said gun is of the unipotential type and having a third grid, a fourth grid and a fifth grid spaced from each other and forming the principal lens, there being an anode voltage ($V_H$) applied to the third and fifth grids and a focus voltage ($V_4$) applied to the fourth grid with the focus voltage being greater than the anode voltage ($V_4 > V_H$), with each of said grids having a vertical segment and a horizontal segment, and wherein the distances between the horizontal and vertical segments of the fourth and fifth grids are equal and the distance between the vertical segments is less than the distance between the horizontal segments for the fourth and fifth grids.

8. An electron gun as in claim 5, wherein each of the grids has a generally hollow and circularly-shaped center having a vertical distance ($D_V$) and a horizontal distance ($D_H$) and in the end face of the third grid facing the fourth grid, the vertical distance is less than the horizontal distance ($D_V < D_H$).

9. An electron gun as in claim 5, wherein each of the grids has a generally hollow and circularly-shaped center having a vertical distance ($D_V$) and a horizontal distance ($D_H$) and in the end face of the fourth grid facing the third grid, the vertical distance is greater than the horizontal distance ($D_V > D_H$).

10. An electron gun as in claim 5, wherein each of the grids has a generally hollow and circularly-shaped center having a vertical distance ($D_V$) and a horizontal distance ($D_H$) and in the end face of the fourth grid facing the fifth grid, the vertical distance is greater than the horizontal ($D_V > D_H$).

11. An electron gun as in claim 5, wherein each of the grids has a generally hollow and circularly shaped center having a vertical distance ($D_V$) and a horizontal distance ($D_H$) and in the end face of the fifth grid facing the fourth grid, the vertical distance is less than the horizontal distance ($D_V < D_H$).

12. An electron gun for a cathode ray tube comprising, an object point forming lens region and a principal converging lens region, at least one through hole for said electron beam in a first grid electrode within said object point forming lens region is formed with an oblong shape such that the object point in the vertical direction is formed at a further position from said principal converging lens region than the object point in the horizontal direction, and the shapes of openings of electrodes within said principal converging lens region are determine such that the converging angle of said electron beam in the vertical direction is smaller than the converging angle in the horizontal direction so as to provide a beam spot with substantially no halo at the corners as well as the center of a screen in said cathode ray tube, and wherein there is further provided a first grid a second grid and a third grid, said first grid defining three oblong-shaped electron beam openings therein and said second grid defining three circularly-shaped electron beam openings therein, and wherein the oblong openings have a height to width ration in the range of $0.7 \leqq h/w < 1$ and the opening in the third grid is an oblong shape having a vertical distance ($D_V$) to horizontal distance ($D_H$) ratio in the range in which $0.7 \leqq D_V/D_H < 1$.

13. An electron gun for a cathode ray tube comprising, an object point forming lens region and a principal converging lens region, at least one through hole for said electron beam in a first grid electrode within said object point forming lens region is formed with an oblong shape such that the object point in the vertical direction is formed at a further position from said principal converging lens region than the object point in the horizontal direction, and the distances between cylindrical grid electrodes within said principal converging lens region and determined such that the converging angle of said electron beam in the vertical direction is smaller than the converging angle in the horizontal direction so as to provide a beam spot with substantially no halo at the corners as well as the center of a screen in said cathode ray tube, wherein there is further provided a first grid a second grid and a thrid grid, said first grid defining three oblong-shaped electron beam openings therein and said second grid defining three circularly-shaped electron beam openings therein, and wherein the oblong openings have a height to width ratio in the range of $0.7 \leqq h/w < 1$ and the opening in the third grid is an oblong shape having a vertical distance ($D_V$) to horizontal distance ($D_H$) ratio in the range in which $0.7 \leqq D_V D/_H < 1$.

* * * * *